United States Patent [19]

Wang

[11] Patent Number: 4,888,837

[45] Date of Patent: Dec. 26, 1989

[54] TOY BED TRANSFORMERS

[76] Inventor: Ted T. H. Wang, Room 401, 168, Chung Cheng 4 Road, Kaohsiung, Taiwan

[21] Appl. No.: 84,234

[22] Filed: Aug. 11, 1987

[51] Int. Cl.[4] ..... A47D 7/01; A47D 15/00; A47C 21/00

[52] U.S. Cl. ..... 5/93 R; 5/508; 5/414; 446/220; D6/597

[58] Field of Search ..... 5/449, 508, 2 R, 414, 5/100, 416, 448, 424, 425, 93 R; D6/597, 601, 606; 272/1 C; 446/220, 901

[56] References Cited

U.S. PATENT DOCUMENTS

| | | | |
|---|---|---|---|
| 3,120,721 | 2/1964 | Bukatman et al. | 5/482 |
| 3,165,759 | 1/1965 | O'Daniell | 5/93 R |
| 3,840,919 | 10/1974 | Middleton | 5/416 |
| 3,951,453 | 4/1976 | Zapf | 297/440 |
| 3,978,610 | 9/1976 | Stubbmann | 5/508 |
| 4,163,297 | 8/1979 | Neumark | 5/455 |
| 4,670,923 | 6/1987 | Gabriel et al. | 5/424 |

FOREIGN PATENT DOCUMENTS

| | | | |
|---|---|---|---|
| 2733708 | 2/1979 | Fed. Rep. of Germany | 446/901 |
| 2551347 | 3/1985 | France | 5/474 |

*Primary Examiner*—Alexander Grosz
*Attorney, Agent, or Firm*—Varndell Legal Group

[57] ABSTRACT

A toy bed transformer including a mattress and various inflatable toy accessories having shapes, such as, an airplane nose, an airplane wing, a cockpit, a rocket, a missile, a tire, a propeller, and a jet engine. The mattress and the inflatable toy accessories have attaching bands thereon and can be attached together by the attaching bands to form different objects mimicking for example, a car, an aircraft, and a tank, according to a child's own imaginative ideas.

9 Claims, 3 Drawing Sheets

TOY BED TRANSFORMERS

BACKGROUND OF THE INVENTION

Children are generally fond of toys. They like to have many different kinds of toys to play with. Their rooms are often filled with toys. A bed is a piece of furniture which is indispensable for a child. If a bed could be modified so that inflatable toys of various shapes, such as, an aircraft, an airplane nose, an airplane wing, a propeller, a tank, a machine gun, a rocket, and a missile, could be attached thereto, a child would be able to enjoy playing with such a bed by attaching the various inflatable toys thereto. This also would facilitate cultivating the child's imagination about science.

SUMMARY OF THE INVENTION

In order to satisfy a child's curiosity and to arouse his imagination, the inventor developed this invention. This invention consists of a mattress and various inflatable toy accessories which can be inflated with air, and then assembled together with the mattress to provide a toy having a shape which can mimic a car, an aircraft, a tank, etc., according to the child's imagination.

DETAILED DESCRIPTION OF THE INVENTION

Figure 1:
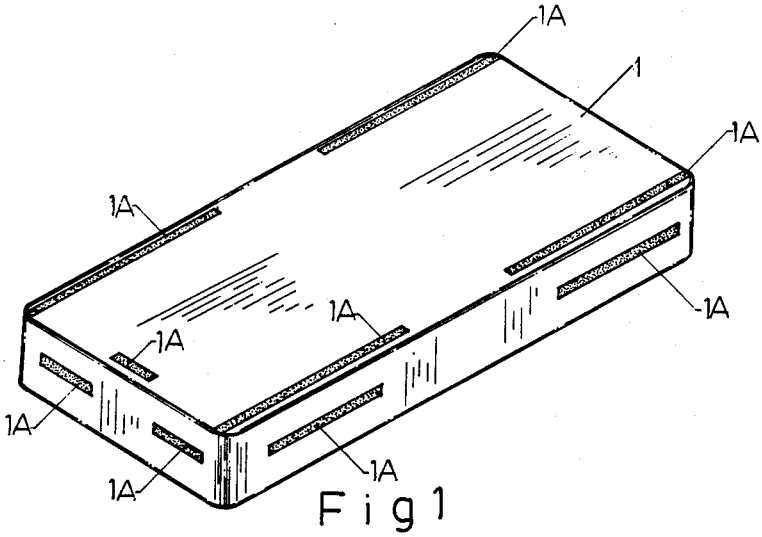
FIG. 1 is a structural view of a mattress according to this invention.
Figure 2:
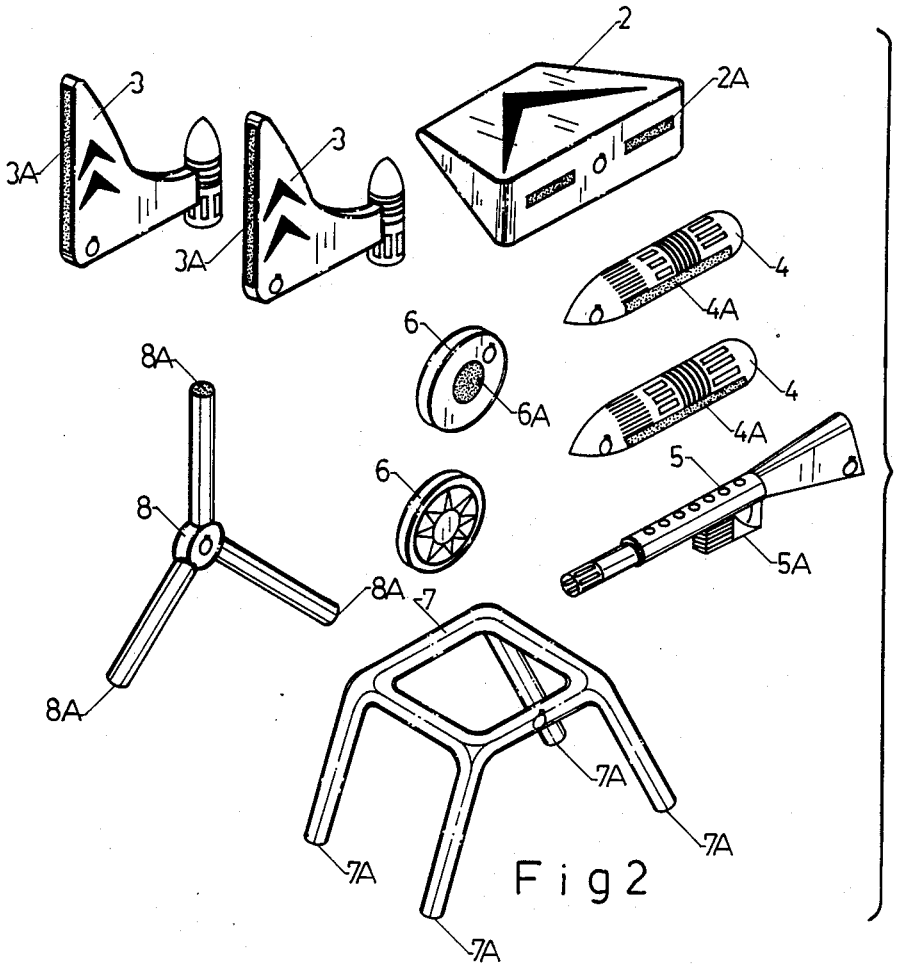
FIG. 2 is a view of a variety of inflatable toy accessories according to this invention.
Figure 3:
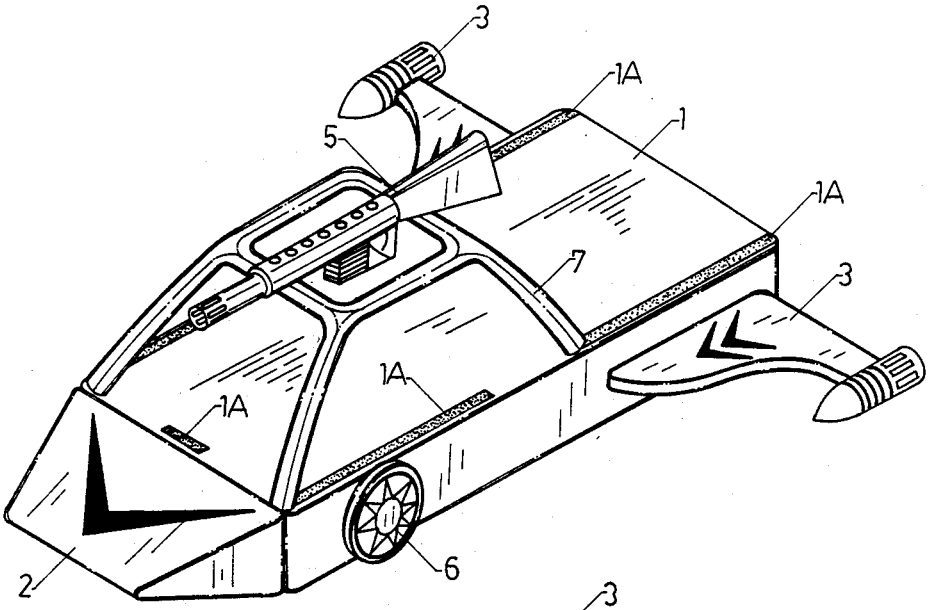
FIG. 3 is a view of an example of a toy made from the mattress with various inflated toy accessories attached thereto according to this invention.
Figure 4:
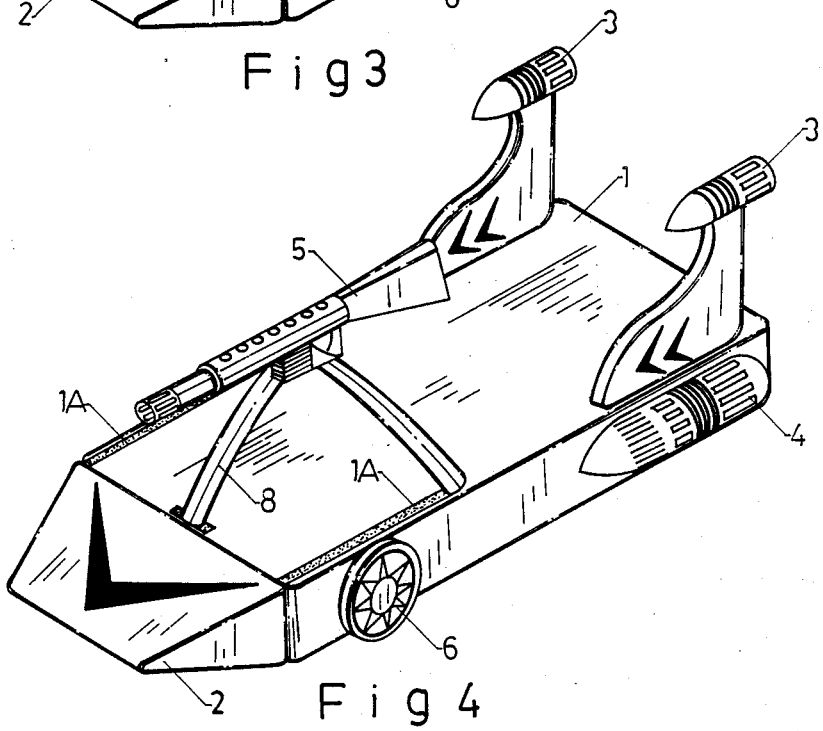
FIG. 4 is a view of another example of a toy made from the mattress with various inflated toy accessories attached thereto according to this invention.
Figure 5:
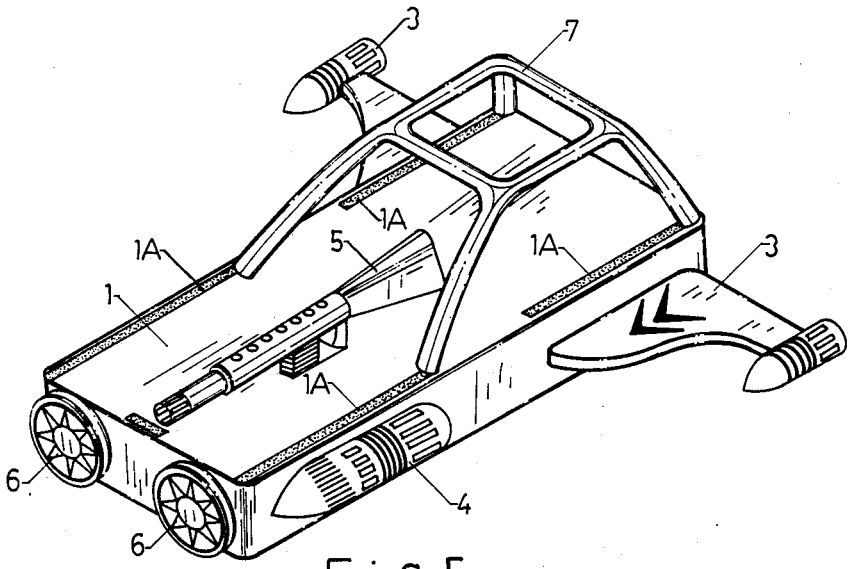
FIG. 5 is a view of a further example of a toy made from the mattress with various inflated toy accessories attached thereto according to this invention.
Figure 6:
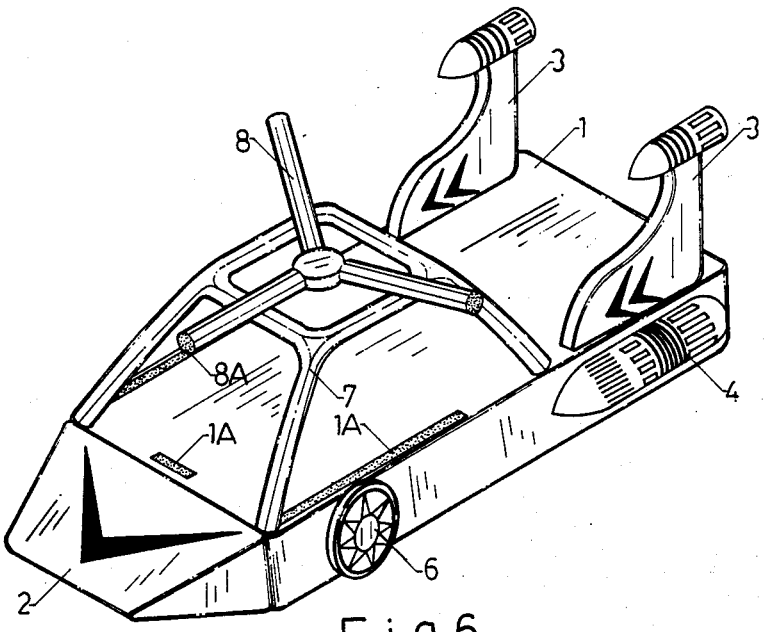
FIG. 6 is a view of a still further example of a toy made from the mattress with various inflated toy accessories attached thereto according to this invention.

FIG. 1 is a structural view of a mattress of this invention. The mattress 1 has a plurality of attaching bands 1A placed on its front, left and right sides by which inflatable toy accessories can be attached thereto. FIG. 2 shows various examples of inflated toy accessories which can be used in this invention. These include an airplane nose 2, an airplane wing 3, a jet engine 4, a missile 5, a tire 6, a cockpit 7, and a propeller 8. Inflated toy accessories other than those shown can also be used. All of the toy accessories 2, 3, 4, 5, 6, 7, and 8 respectively have an attaching band 2A, 3A, 4A, 5A, 6A, 7A, and 8A for attaching the toy accessories to the mattress 1. Moreover, each of the accessories can be printed with any suitable design. The tire 6 can also be used as a light cover, and the propeller 8 can be bent into the different shape of a cockpit, as shown in FIG. 4. The toy accessories can be attached to the mattress 1 in any manner and according to the child's imagination, in order to form toy objects, such as, a vehicle, a tank, and an aircraft. FIGS. 3, 4, and 5 are examples of the above-mentioned toy accessories attached to the mattress in a different combinations to provide a shape respectively mimicking a fighter airplane, a tank and a flying car. Since the toy accessories are inflatable and can easily be attached to or removed from the mattress 1, children can construct different structures. This can improve a child's thinking abilty in science. Also, their curiosity can be satisfied in their attempt to make different structures.

What is claimed is:

1. A toy bed transformer which comprises:

a mattress having at least two releasable fastening means at different locations thereon, at least one being located on the top portion of the mattress and at least one being located on a side or end portion of the mattress, and at least two inflatable toy accessory means having matching releasable fastening means, wherein the at least two inflatable toy accessory means can be interchangeably fasten to the mattress by their respective fastening means at the different locations thereon whereby the mattress and the inflatable accessory means simulate a vehicle.

2. A toy bed transformer as set forth in claim 1, wherein the at least two inflatable toy accessory means include imitations of a front portion of an airplane, a jet engine, a rocket, a missile, an airplane wing, a tire, an airplane cockpit, and an airplane propeller.

3. A toy bed transformer as set forth in claim 1, wherein the at least two inflatable toy accessory means include a light cover in a shape of a tire.

4. A toy bed transformer as set forth in claim 1, wherein the at least two inflatable toy accessory means include an imitation of a propeller having three bendable projections extending from a common center, each projection having the matching releasable fastening means at the ends thereof, wherein the propeller can be fastened to the mattress at the ends of the three bendable projections in the form of an airplane cockpit.

5. A toy bed transformer as set forth in claim 4, wherein the at least two inflatable toy accessory means further include imitations of two airplane wings and at least one rocket and tire, the imitation of a propeller being fastened to the mattress at the ends of the three bendable projections in the form of an airplane cockpit, and the two wings and at least one rocket and tire are attached tot he mattress in a manner to mimic a tank.

6. A toy bed transformer as set forth in claim 1, wherein the at least two inflatable toy accessories means include an imitation of an airplane cockpit having a top in the shape of a square with projections extending from corners thereof, the projections having the matching releasable fastening means at the ends thereof, and the airplane cockpit is fastened to the mattress at the ends of the projections.

7. A toy bed transformer as set forth in claim 1, wherein the at least two inflatable toy accessory means include imitations of a front portion of an airplane, two airplane wings and a missile, and the inflatable toy accessory means of the front portion of an airplane, the two airplane wings, and the airplane cockpit are attached to the mattress to resemble a fighter airplane.

8. A toy bed transformer which comprises:

a mattress having at least two releasable fastening means at different locations thereon, at least one being located on the top portion of the mattress and at least one being located on a side or end portion of the mattress, and at least two inflatable toy accessory means having matching releasable means for a child to attach the at least two inflatable toy accessory means to the at least two releasable fastening means of the mattress and for a child to remove the at least two inflatable toy accessory means for the at least two releasable fastening means of the mattress, wherein the at least two inflatable toy accessory means can be interchangeably fastened to the at least two releasable fastening means of the mattress whereby the mattress and the inflatable accessory means simulate a vehicle.

9. A toy bed transformer as set forth in claim 8, wherein the at least two inflatable toy accessory means include imitations of a front portion of an airplane, a jet engine, a rocket, a missile, an airplane wing, a tire, and airplane cockpit, and an airplane propeller.

* * * * *